US009909836B2

(12) United States Patent
Galletta, II

(10) Patent No.: US 9,909,836 B2
(45) Date of Patent: Mar. 6, 2018

(54) RIFLE HANDGUARD SYSTEM

(71) Applicant: John Galletta, II, Riverside, CA (US)

(72) Inventor: John Galletta, II, Riverside, CA (US)

( * ) Notice: Subject to any disclaimer, the term of this patent is extended or adjusted under 35 U.S.C. 154(b) by 0 days.

(21) Appl. No.: 15/369,584

(22) Filed: Dec. 5, 2016

(65) Prior Publication Data

US 2017/0160048 A1 Jun. 8, 2017

Related U.S. Application Data

(60) Provisional application No. 62/263,410, filed on Dec. 4, 2015.

(51) Int. Cl.

| | |
|---|---|
| ***F41C 23/00*** | (2006.01) |
| ***F41C 23/16*** | (2006.01) |
| ***F41A 21/48*** | (2006.01) |
| ***F41A 3/66*** | (2006.01) |
| ***F41A 5/18*** | (2006.01) |

(52) U.S. Cl.
CPC ..... *F41C 23/16* (2013.01); *F41A 3/66* (2013.01); *F41A 5/18* (2013.01); *F41A 21/48* (2013.01)

(58) Field of Classification Search
CPC ..... F41C 23/16
See application file for complete search history.

(56) References Cited

U.S. PATENT DOCUMENTS

| | | | | |
|---|---|---|---|---|
| 6,671,990 | B1 * | 1/2004 | Booth | F41C 23/16 42/75.01 |
| 7,770,317 | B1 * | 8/2010 | Tankersley | F41C 23/16 42/71.01 |
| 8,863,426 | B1 * | 10/2014 | Zinsner | F41C 23/16 42/71.01 |
| 8,904,691 | B1 * | 12/2014 | Kincel | F41C 23/16 42/71.01 |
| 9,389,043 | B1 * | 7/2016 | Zhang | F41C 23/16 |
| 9,683,808 | B2 * | 6/2017 | Gagnon | F41C 23/16 |
| 2011/0126443 | A1 * | 6/2011 | Sirois | F41C 23/16 42/90 |
| 2011/0247254 | A1 * | 10/2011 | Barnes | F41A 21/48 42/71.01 |
| 2012/0180358 | A1 * | 7/2012 | Samson | F41A 13/12 42/71.01 |
| 2012/0324775 | A1 * | 12/2012 | Troy | F41C 23/16 42/71.01 |
| 2017/0097207 | A1 * | 4/2017 | Hines | F41A 21/48 |

* cited by examiner

*Primary Examiner* — Gabriel Klein
(74) *Attorney, Agent, or Firm* — Loeb & Loeb LLP

(57) ABSTRACT

The rifle handguard system may include a barrel nut configured to fasten to an upper receiver of a rifle and further configured to carry a rifle barrel. The system may also include a rifle handguard having a muzzle end and a receiver end. The receiver end may be shaped to receive the barrel nut. The receiver end may further include means for affixing the rifle handguard to the barrel nut via friction between an inner surface of the rifle handguard and an outer surface of the barrel nut.

17 Claims, 11 Drawing Sheets

RIFLE HANDGUARD SYSTEM

CROSS-REFERENCES TO RELATED APPLICATIONS

This application claims the benefit of U.S. Provisional Application No. 62/263,410, entitled "RIFLE HANDGUARD SYSTEM" filed Dec. 4, 2015, the disclosure of which is entirely incorporated herein by reference.

BACKGROUND

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

The present invention generally relates to a handguard system for a rifle.

Semi-automatic rifles are some of the most popular sporting firearms in the world. These rifles rely on gas-operated reloading for automatic operation. In the firing cycle of semi-automatic rifles, a portion of combustion gas that propels a bullet from the rifle is used to operate a bolt mechanism at the receiver to reload another cartridge into the rifle chamber for subsequent firing. Since the gas is primarily used to propel the bullet through the barrel, relatively low-pressure gas is typically vented through the reloading system from at or near the muzzle. This requires some form of piston chamber or tube to communicate this gas from the muzzle backwards to the receiver. Among the types of mechanisms to effect automatic reloading are piston and direct impingement systems. In a piston-driven system, the piston is mechanically fixed to the bolt group and moves through the entire operating cycle. A direct impingement system eliminates the piston by venting combustion gas through a tube from the muzzle to the receiver of the rifle where gas forces components to directly impinge on the bolt carrier.

With either system, the user typically supports the rifle by holding a handguard that surrounds the barrel and the portions of the gas system that are forward of the receiver. On "AR" type rifles with free-floating barrels, the handguard is affixed to a barrel nut. The barrel nut also secures the barrel to the upper receiver. Barrel nuts must also be configured to allow the gas system components to communicate energy (in a piston system) or combustion gas (in a direct impingement system) into the receiver. To accommodate both the gas system and handguard, typical barrel nuts will have multiple, radially-spaced holes or sprocket-like notches to allow the gas tube or piston component to pass over or through the nut and into the receiver. To affix the handguard to the nut, some handguards will utilize the barrel nut notches with a spring-tensioned ring or be secured by bolts through the handguard into the nut via a series of tapped holes in the nut.

With either method of affixing both the barrel and handguard to the receiver, the barrel nut must be "timed" to exactly align one or more of the gas component holes and the handguard-securing holes. Such alignment ensures the gas system components are not improperly stressed or bent during function and that front sights or other precise components attached to the handguard are positioned in a desired manner.

Timing the barrel nut for proper alignment of the gas system, receiver, and handguard can be troublesome and time consuming. And since the barrel nut must be secured within certain torque tolerances, alignment may become even more complicated. Typically, one or more shims may be placed between the nut and receiver to achieve proper torque and alignment. However, shim placement is often time consuming as proper alignment can only be measured when a shim is in place. If the placed shim does not achieve the desired results, the process must be repeated until alignment within torque tolerances is achieved.

SUMMARY

Features and advantages described in this summary and the following detailed description are not all-inclusive. Many additional features and advantages will be apparent to one of ordinary skill in the art in view of the drawings, specification, and claims hereof. Additionally, other embodiments may omit one or more or all of the features and advantages described in this summary.

The rifle handguard system may include a handguard having a muzzle end and a receiver end. The receiver end may include a sleeve chamber shaped to receive a sleeve. The sleeve may be affixed to the handguard via a sleeve mounting fastener. The sleeve mounting fastener may abut a barrel nut within the handguard, the barrel nut carrying a rifle barrel. The sleeve mounting fastener may abut the barrel nut such that a force of the fastener against the barrel nut may align the barrel nut and the barrel within the handguard. In some embodiments, the handguard may include at least two sleeve chambers each having sleeves affixed to the handguard via corresponding sleeve mounting fasteners. The at least two sleeve mounting chambers may be positioned within the handguard such that a sector "A" and a sector "B" are equal and adjacent. For example, when the barrel nut is positioned within the handguard receiver end, sector "A" includes a radius drawn through a first sleeve mounting fastener, sector "B" includes a radius drawn through a second sleeve mounting fastener, and sector "A" and sector "B" share a radius drawn from the barrel nut centerline. When tightened, the sleeve mounting fasteners each exert a radial force against the barrel nut, thus aligning the barrel nut and barrel within the handguard.

The barrel nut may be configured for use with rifles that cycle by direct impingement or gas piston. For example, in a gas piston-configured rifle, the barrel nut may include a drive rod channel to accommodate the gas piston system. In a direct impingement-configured rifle, the barrel nut may not include the channel.

In some embodiments, the rifle handguard system may include a barrel nut configured to fasten to an upper receiver of a rifle and further configured to carry a rifle barrel. The system may also include a rifle handguard having a muzzle end and a receiver end. The receiver end may be shaped to receive the barrel nut. The receiver end may further include means for affixing the rifle handguard to the barrel nut via friction between an inner surface of the rifle handguard and an outer surface of the barrel nut.

In further embodiments, the rifle handguard system may include a barrel nut configured to fasten to an upper receiver of a rifle and further configured to carry a rifle barrel and a rifle handguard having a muzzle end and a receiver end. The receiver end may be shaped to receive the barrel nut, and the receiver end may further include one or more sleeve mounting screw holes and one or more threaded sleeve mounting fasteners corresponding to the one or more sleeve mounting screw holes. The rifle handguard may also include at least two sleeve chambers running along at least a portion of a longitudinal axis of the handguard. The at least two sleeve chambers may be shaped to receive at least two sleeves that include threaded holes for receiving the one or more threaded sleeve mounting fasteners. The threaded sleeve mounting fasteners may be configured to exert a radial force against the barrel nut that also forces a top portion of the barrel nut outer surface against an inner surface of a top portion of the rifle handguard.

Persons of ordinary skill in the art will appreciate that elements in the figures are illustrated for simplicity and clarity so not all connections and options have been shown to avoid obscuring the inventive aspects. For example, common but well-understood elements that are useful or necessary in a commercially feasible embodiment are not often depicted in order to facilitate a less obstructed view of these various embodiments of the present disclosure. It will be further appreciated that certain actions and/or steps may be described or depicted in a particular order of occurrence while those skilled in the art will understand that such specificity with respect to sequence is not actually required. It will also be understood that the terms and expressions used herein are to be defined with respect to their corresponding respective areas of inquiry and study except where specific meanings have otherwise been set forth herein.

DETAILED DESCRIPTION

Figure 1:
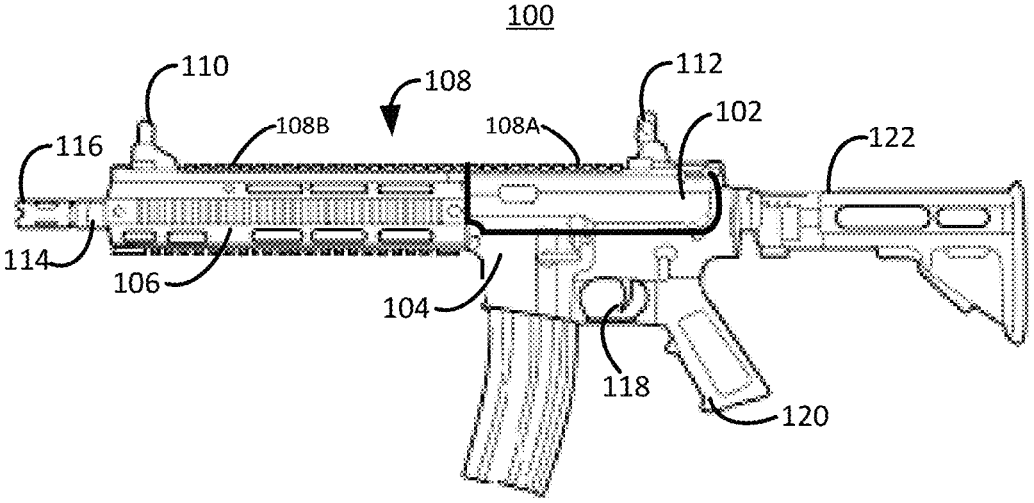
FIG. 1 illustrates one embodiment of a rifle.

FIG. 1 shows one embodiment of a rifle 100. The rifle 100 includes an upper receiver 102 and a lower receiver 104. The rifle includes a handguard 106 having an attachment rail 108 having a first portion 108A along the top of the receiver 102 and a second portion 108B along the top of the handguard 106. In use, the first portion 108A and the second portion 108B are aligned such that the attachment rail 108 runs continuously along a top portion of both the handguard 106 and the upper receiver 102. In some embodiments, the rail 108 may include a MIL-STD-1913 rail or Picatinny rail for the attachment of a front sight 110 and a rear sight 112 and other components to the handguard 106. The rifle 100 includes a barrel 114 having a muzzle 116 at its distal end from attachment to the upper receiver 102. The rifle may also include a trigger 118, grip 120, and buttstock 122.

Figure 2:
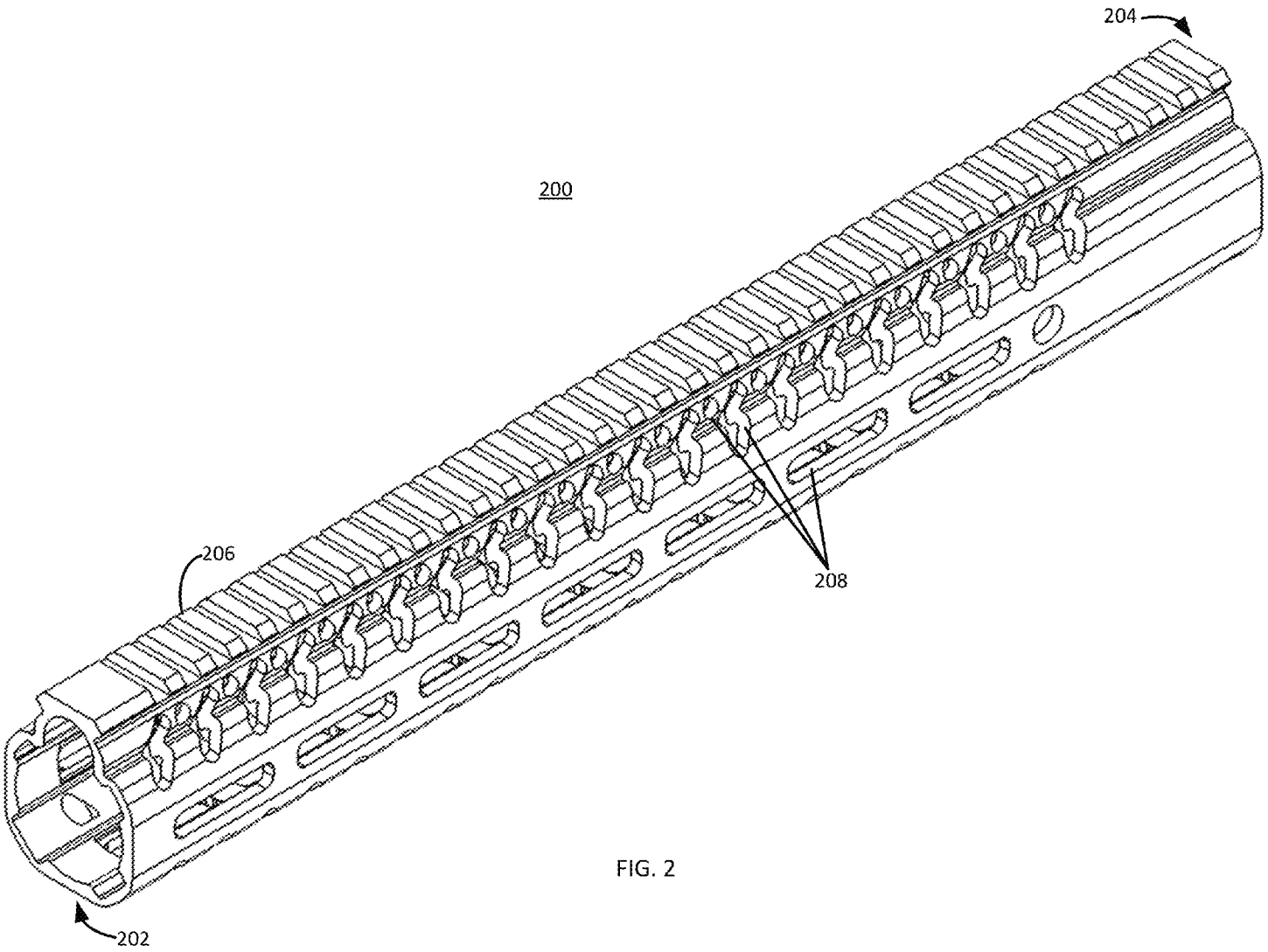
FIG. 2 illustrates an isometric view of a rifle handguard in accordance with the embodiments described herein.

FIG. 2 shows an isometric view of a handguard 200 that may be employed with the rifle 100. The handguard 200 includes a muzzle end 202 and a receiver end 204. Along a top surface, the handguard 200 may include an attachment rail 206. In some embodiments, the rail 206 may include a MIL-STD-1913 rail or Picatinny rail for the attachment of sighting and other components to the handguard 200 (e.g., front and rear sights 110 and 112). The handguard 200 may also include a number of cutouts 208. The cutouts 208 may allow components that are within the handguard to cool during and after firing. Further, a user may access rifle components through the cutouts 208 without removing the handguard from the rifle. For example, the user may access and adjust gas system components that are fitted along the barrel 114 without removing the handguard 200 from the rifle 100. In some embodiments, the handguard 200 may be made of aluminum or other lightweight material.

Figure 3A:
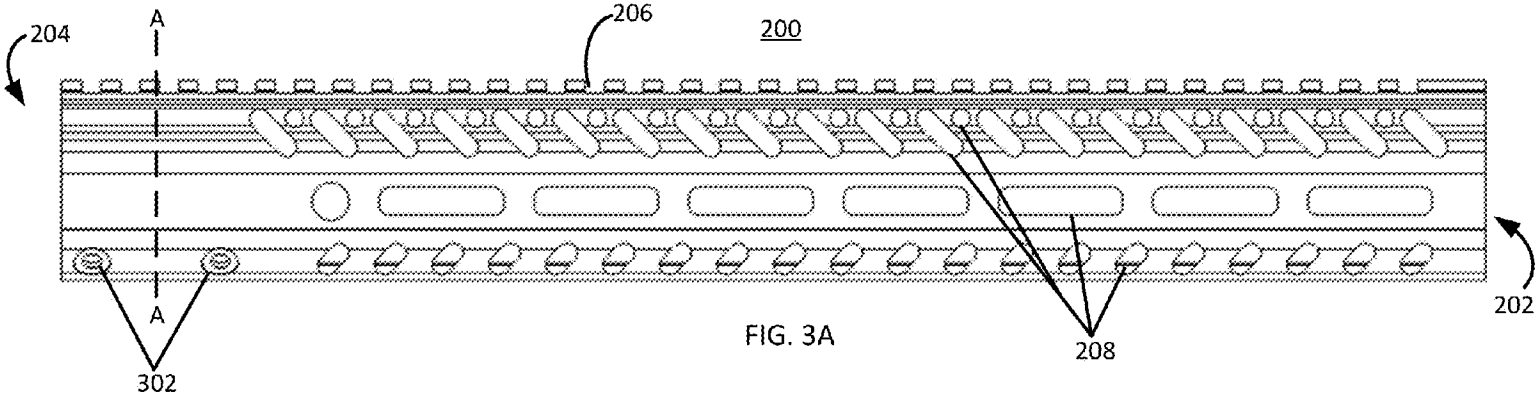
FIG. 3A illustrates a right-side view of a rifle handguard in accordance with the embodiments described herein.
Figure 3B:
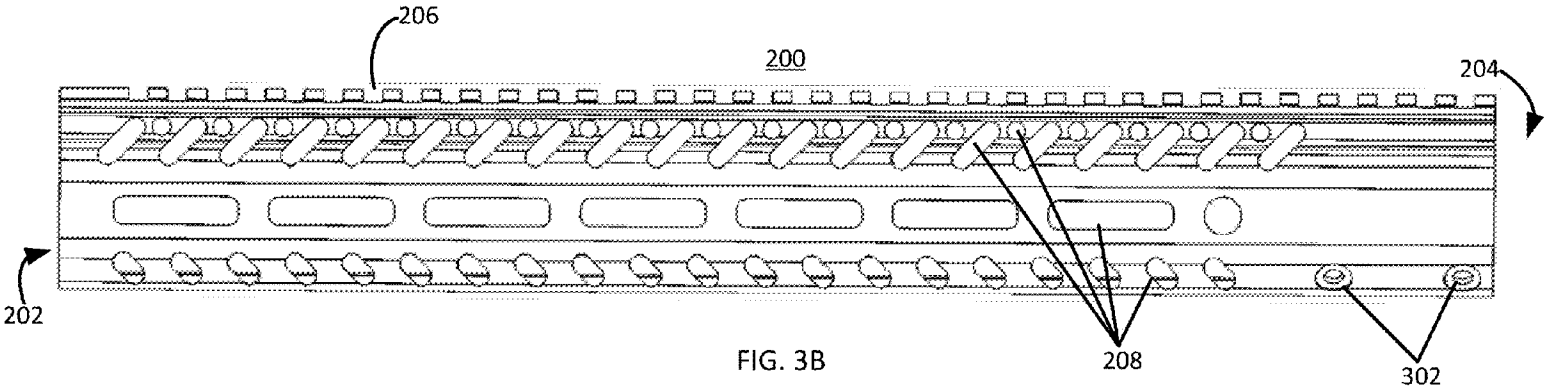
FIG. 3B illustrates a left-side view of a rifle handguard in accordance with the embodiments described herein.

FIG. 3A illustrates a right-side view of the handguard 200 and FIG. 3B shows a left-side view of the handguard 200. At the receiver end 204, the handguard 200 includes a means for affixing the handguard to a barrel nut, the barrel nut affixed to the upper receiver 102 and carrying the barrel 114. In some embodiments, the means for affixing the handguard to the barrel nut may include one or more sleeve mounting screw holes 302 where the sleeve mounting screw holes 302 may be threaded to act as a nut in cooperation with fasteners as herein described.

Figure 4A:
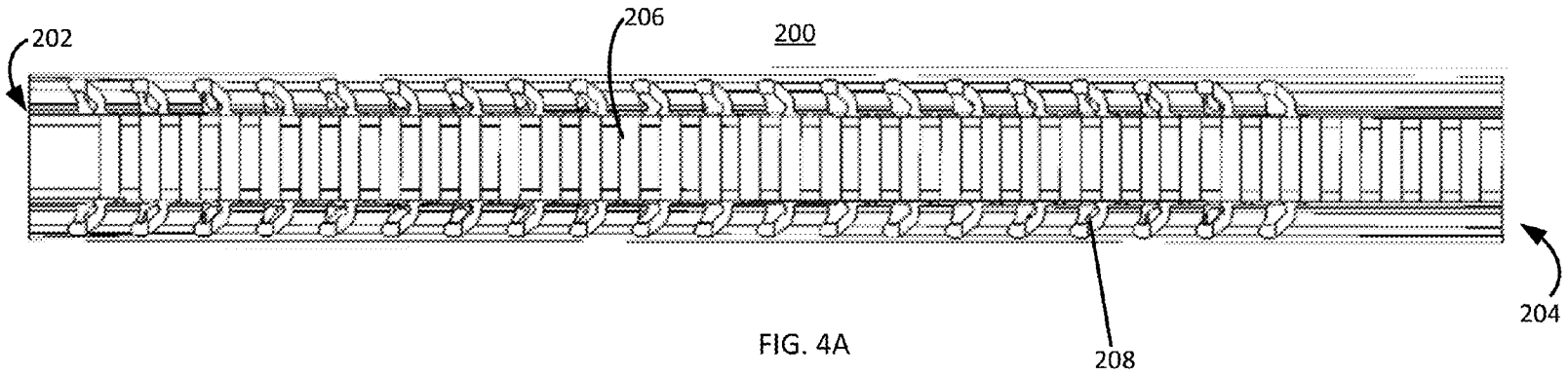
FIG. 4A illustrates a top-view of a rifle handguard in accordance with the embodiments described herein.
Figure 4B:
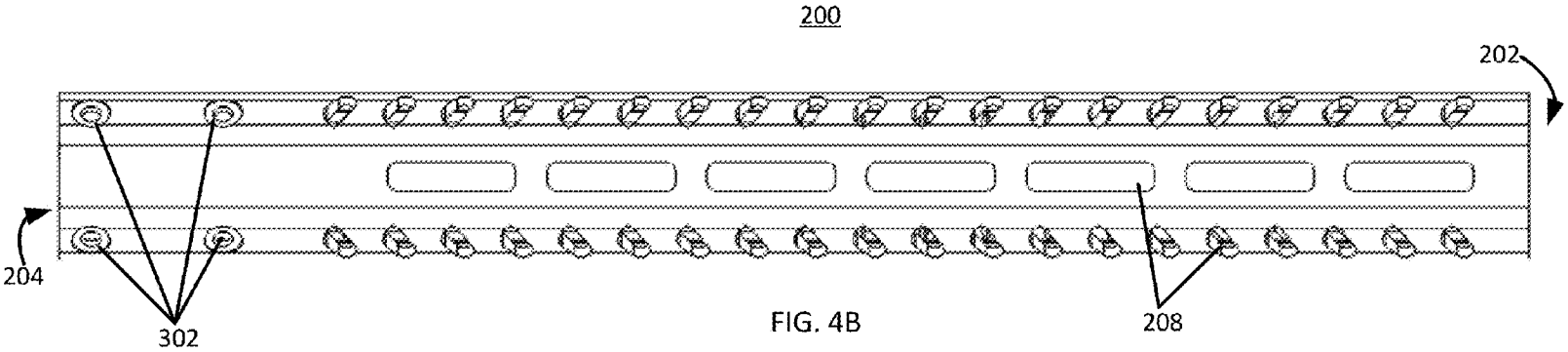
FIG. 4B illustrates a bottom-view of a rifle handguard in accordance with the embodiments described herein.

FIG. 4A illustrates a top view of the handguard 200 and FIG. 4B shows a bottom view of the handguard 200. As also shown in FIGS. 3A and 3B, the handguard 200 includes one or more sleeve mounting screw holes 302 at the receiver end 204.

Figure 5:
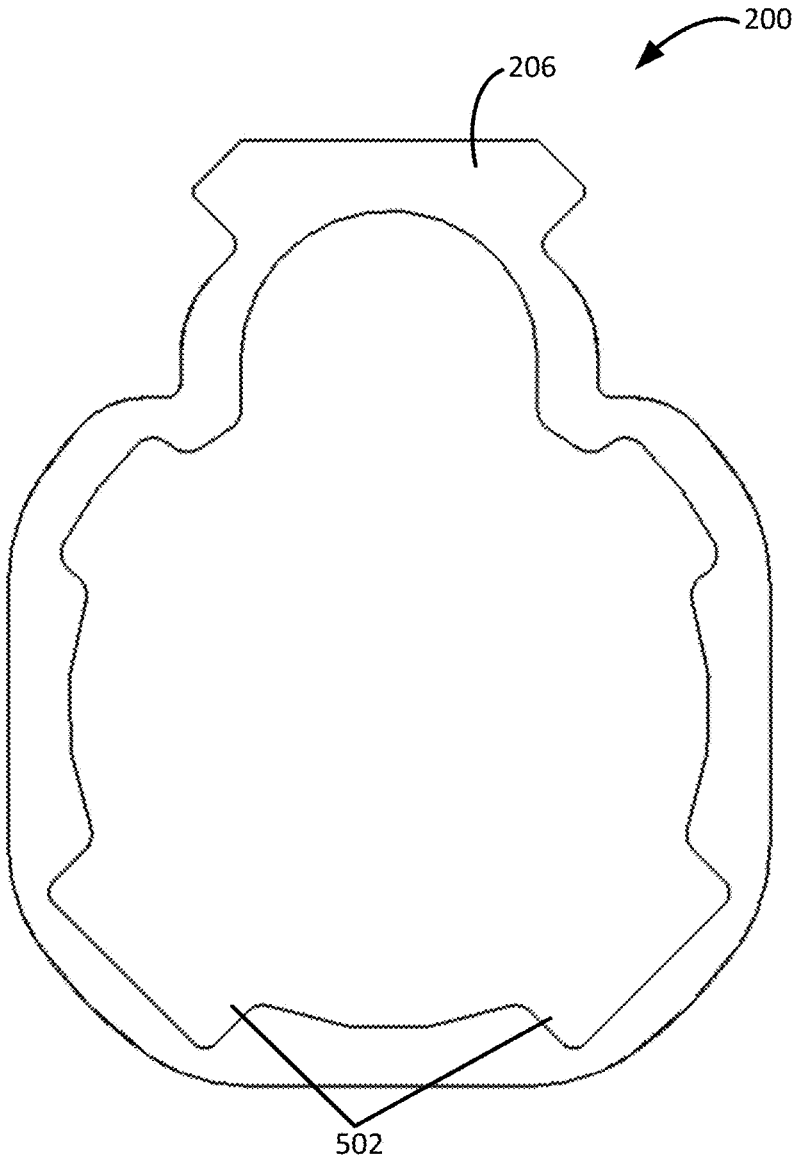
FIG. 5 illustrates cross-sectional view of a rifle handguard in accordance with the embodiments described herein.
Figure 6:
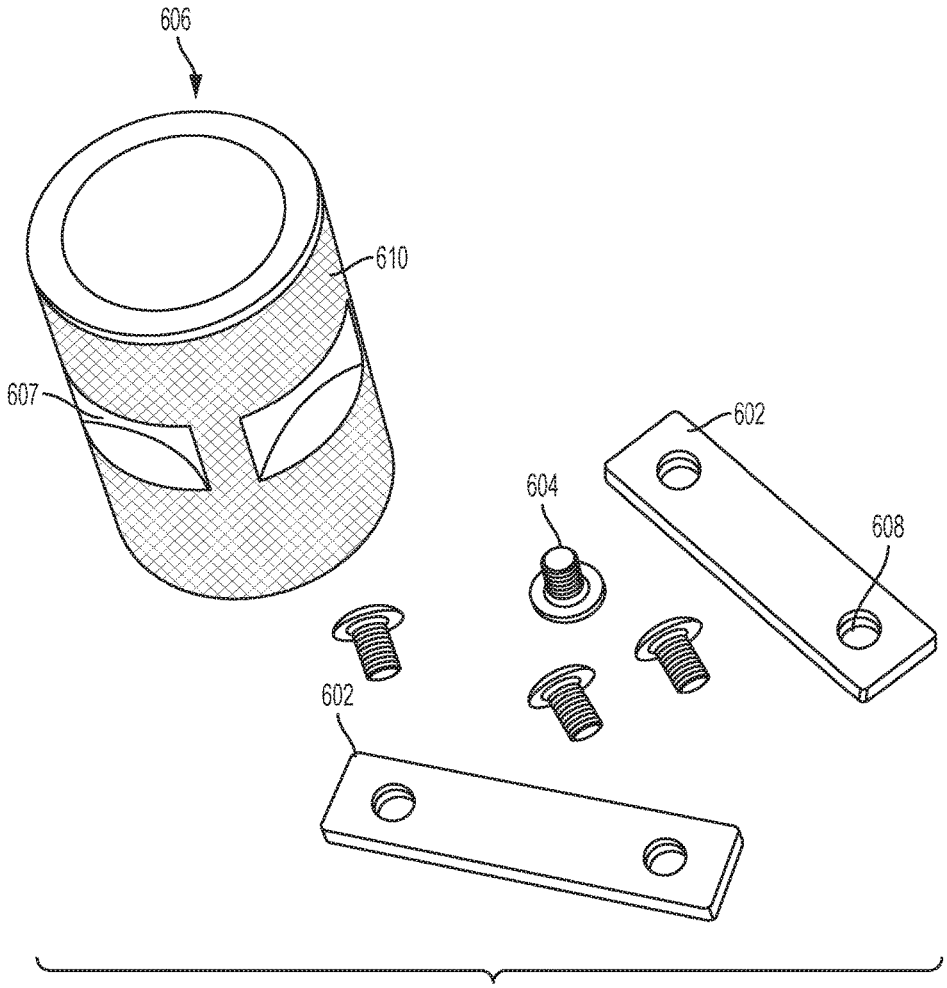
FIG. 6 illustrates a direct impingement system barrel nut, barrel nut sleeves, and sleeve mounting fasteners in accordance with the embodiments described herein.

FIG. 5 shows a cross-sectional view of the handguard 200. The cross-sectional view of FIG. 5 is taken along line A-A as shown in FIG. 3A, but could be taken along any portion of the handguard 200. The handguard 200 includes one or more sleeve chambers 502 within the handguard 200. In some embodiments, the one or more sleeve chambers run along at least a portion of the longitudinal axis of the handguard. The sleeve chambers 502 may be shaped to receive a sleeve, such as sleeve 602 shown in FIG. 6. The sleeve 602 may be affixed to the handguard 200, for example, via one or more sleeve mounting fasteners 604, but other suitable fastening mechanisms are also contemplated herein. The sleeve 602 may be made of a first material (e.g., steel or other hardened material) that is harder than a second material of the handguard 200 (e.g., aluminum or other lightweight material). The sleeve mounting fastener 604 may be configured to abut a barrel nut 606 within the handguard 200, the barrel nut 606 shaped to carry the rifle barrel 114 where the barrel nut 606 is configured to affix the barrel 114 to the upper receiver 102. The barrel nut 606 may include one or more gripping means 607 to allow rotational force to be exerted against the nut 606 while the nut 606 is carrying the barrel 114 and being affixed to the upper receiver 102. In some embodiments, the gripping means 607 include a flat area whereby a crescent or other wrench may be used to apply rotational force to the nut 606. The sleeve mounting fastener 604 may abut the barrel nut 606 such that a force of the fastener 604 against the barrel nut may align the barrel nut 606 and the barrel 114 within the handguard 200. In some embodiments, each sleeve 602 may include one or more mounting holes 608 shaped to receive a fastener 604 where the holes 608 of the sleeve 602 are threaded to mate with similar threading on each fastener 604.

Figure 7:
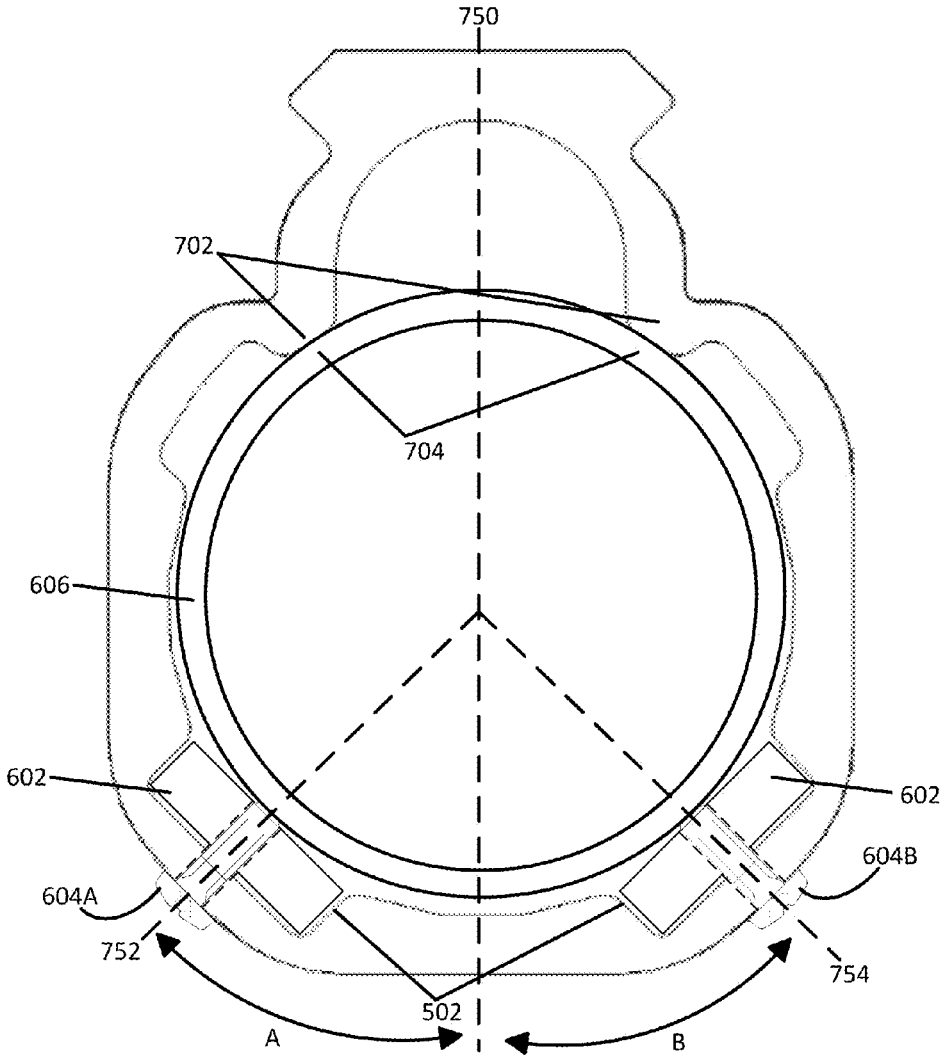
FIG. 7 illustrates an end view of a rifle handguard further illustrating placement of a barrel nut, sleeves, and sleeve fasteners placed therein in accordance with the embodiments described herein.

With reference to FIG. 7, the one or more fasteners 604 may frictionally engage the outer surface of the barrel nut 606 to hold the handguard 200 in place around the nut 606. For example, the one or more fasteners 604A, 604B may engage the nut 606 via friction. Knurling or some other cut pattern in the outer surface 608 of the barrel nut 606 may provide sufficient frictional engagement between the handguard 200 and barrel nut 606. In further embodiments, the one or more fasteners 604A, 604B may engage the nut 606 via further threaded holes within the nut 606. The fastener 604A, 604B may then affix the handguard 200 around the nut 606 by being tightened into the nut 606. In still further embodiments, with additional reference to FIG. 3, the one or more sleeve mounting screw holes 302 of the handguard 200 may be threaded to receive the one or more fasteners 604A, 604B. Thus, the holes 302 of the handguard 200 may be threaded to mate with similar threading on each fastener 604A, 604B and, in such embodiments, the sleeves 602 may be eliminated.

With further reference to FIG. 7, for the purposes of illustration, centerline 750 indicates a centerline of the barrel nut 606. In some embodiments, the at least two sleeve mounting chambers 502 or other means for affixing the handguard 200 to the barrel nut 606 may be positioned within or around the handguard 200 such that the indicated a sector "A" and a sector "B" are equal and adjacent. In some embodiments, each sector defines an angle of less than ninety degrees such that, in use, a first fastener 604A is positioned greater or less than 180 degrees around an outer surface of the barrel nut 606 from a second fastener 604B. For the purposes of illustration, a first radius 752 is shown extending from the center 756 of the nut 606 through the first fastener 604A, and a second radius 754 is shown extending from the center of the nut through the second fastener 604B. In some embodiments, when the barrel nut 606 is positioned within the receiver end 204 of the handguard 200, sector "A" may be defined as the angle between the radius 752 drawn through the first sleeve mounting fastener 604A and the centerline 750, and sector "B" may be defined as the angle between the radius 754 drawn through the second sleeve mounting fastener 604B and the centerline. When tightened, the sleeve mounting fasteners 604A and 604B each exert a radial force against the barrel nut that also forces a top portion of the barrel nut 704 outer surface against a top portion of the handguard 702 inner surface, thus aligning the handguard 200 around the barrel nut 606 and barrel 114.

Thus, means for affixing the handguard 200 to the barrel nut 606 may include a threaded fastener and nut arrangement to frictionally secure the handguard 200 around the barrel nut 606. For example, a threaded portion of the handguard may act as a nut for the threaded fasteners 604 and/or the sleeve 602 fitting within the sleeve chamber 502 act as the nut. Other means for affixing the handguard 200 to the barrel nut 606 may include a cam or compression latch arranged to squeeze the handguard 200 down around the barrel nut 606, or any other means to frictionally easily secure the handguard to the barrel nut 606 without performing the timing process as herein described.

Figure 8:
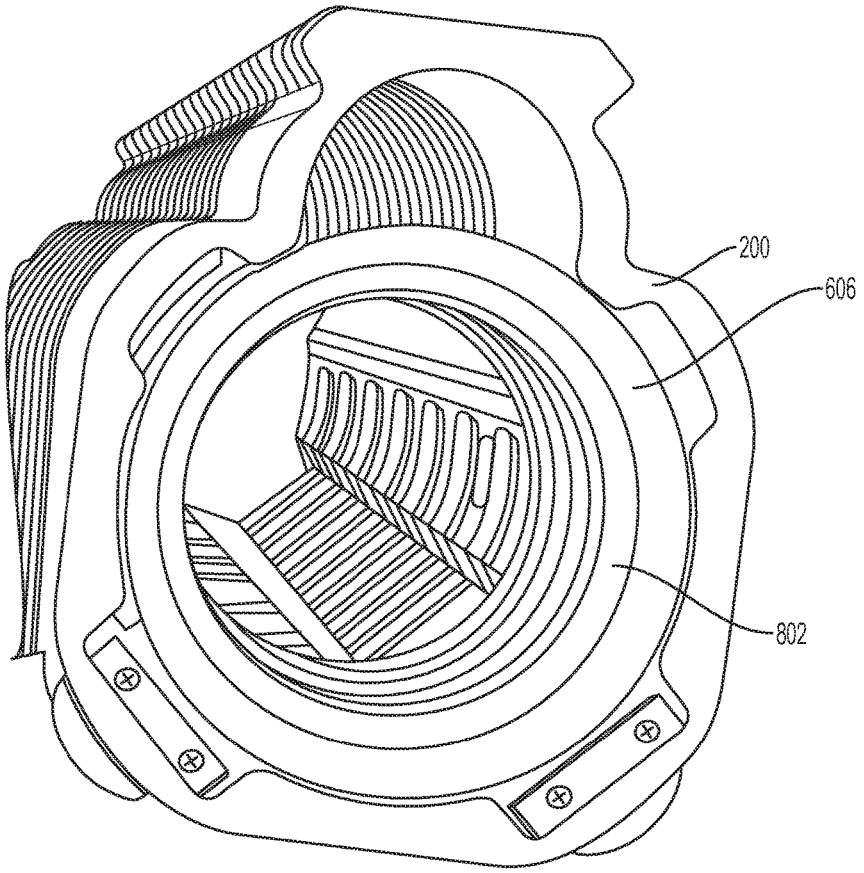
FIG. 8 illustrates a further end view of a rifle handguard having a barrel nut, sleeves, and sleeve fasteners placed therein in accordance with the embodiments described herein.

With reference to FIG. 8, the barrel nut 606 may include an affixing means 802 to affix the barrel nut 606 to the upper receiver 102. In some embodiments, the means 802 includes a first threaded portion that mates with a second threaded portion of the upper receiver 102.

In use, the barrel nut 606 may be affixed to the upper receiver 102 with a force ranging from about 35 to 85 foot/pounds of torque. The handguard 200 may then be secured to the barrel nut 606 with two or more sleeve mounting fasteners 604. Timing the barrel nut 606 and the use of shims or other material to facilitate the typical timing process to align the barrel 114, barrel nut 606, and handguard 200 is, thus, unnecessary.

Figure 9:
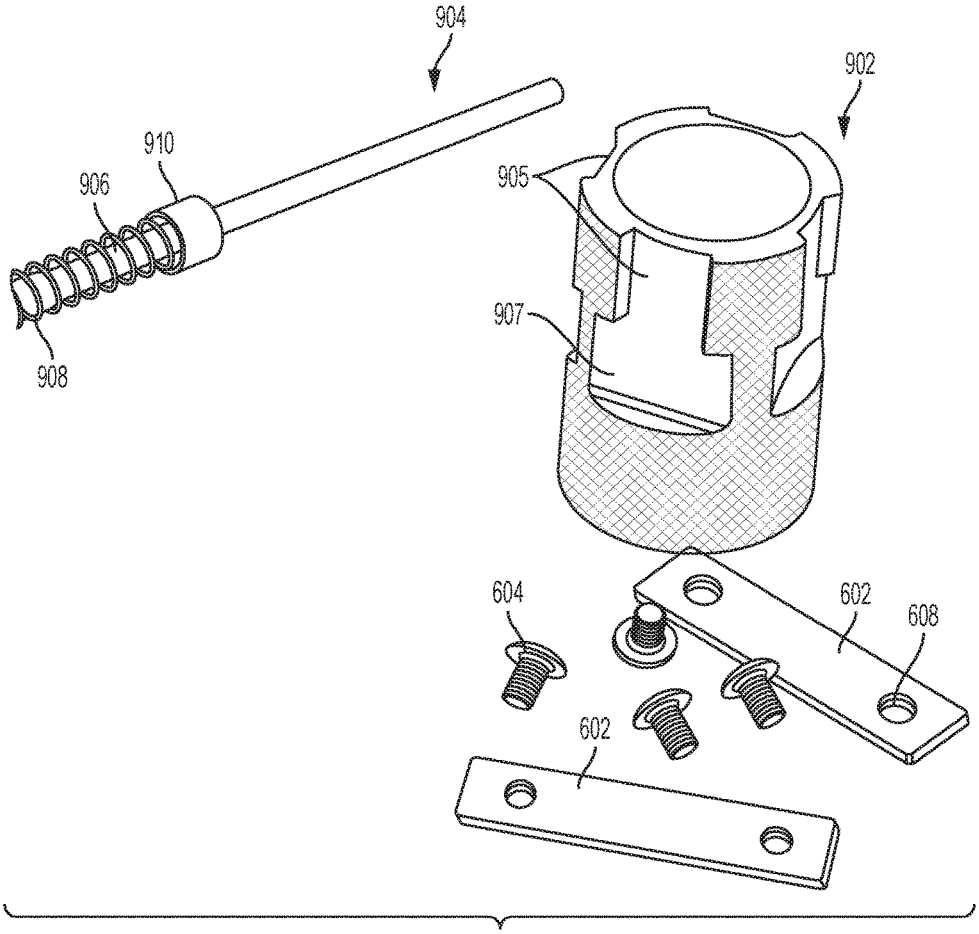
FIG. 9 illustrates a piston system barrel nut, piston system components, barrel nut sleeves, and sleeve mounting fasteners in accordance with the embodiments described herein.
Figure 10:
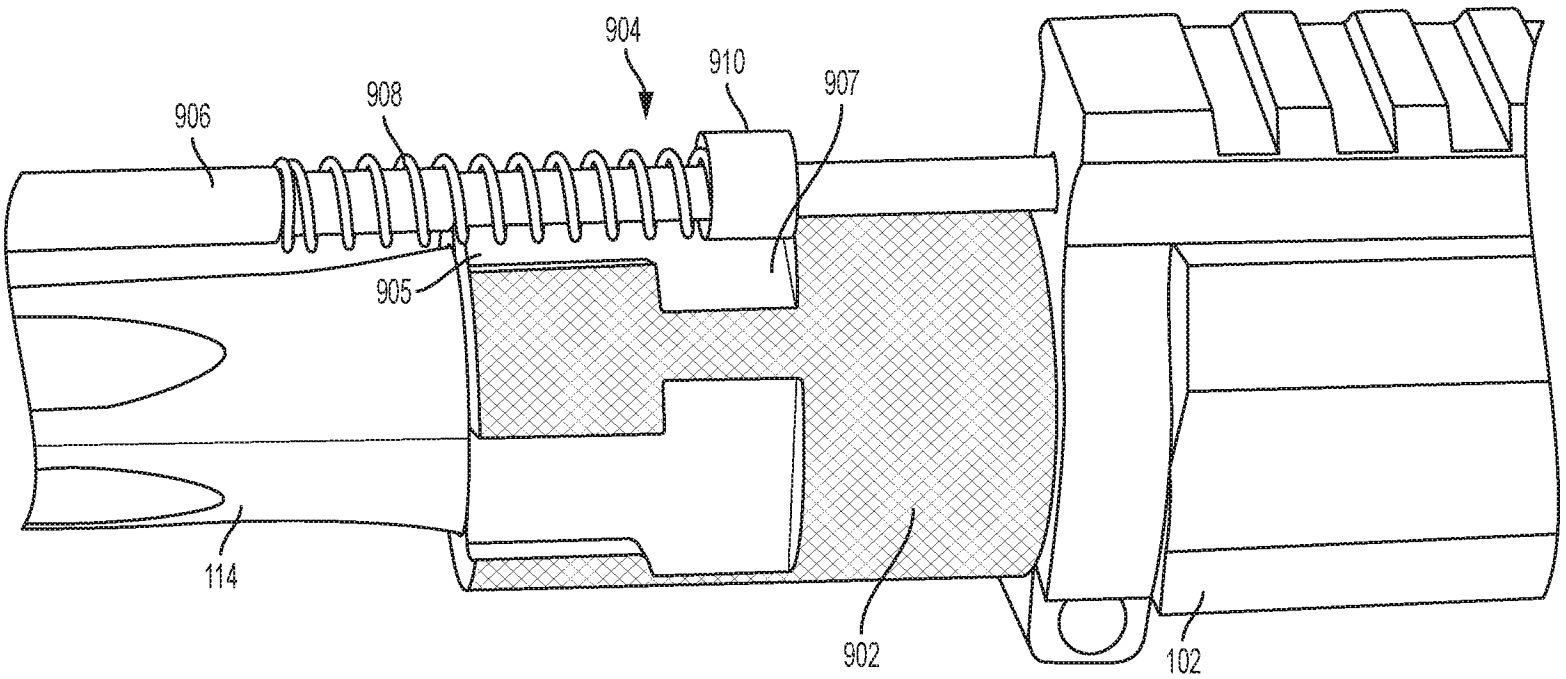
FIG. 10 further illustrates a piston system barrel nut and related components mounted on a rifle in accordance with the embodiments described herein.
Figure 11:
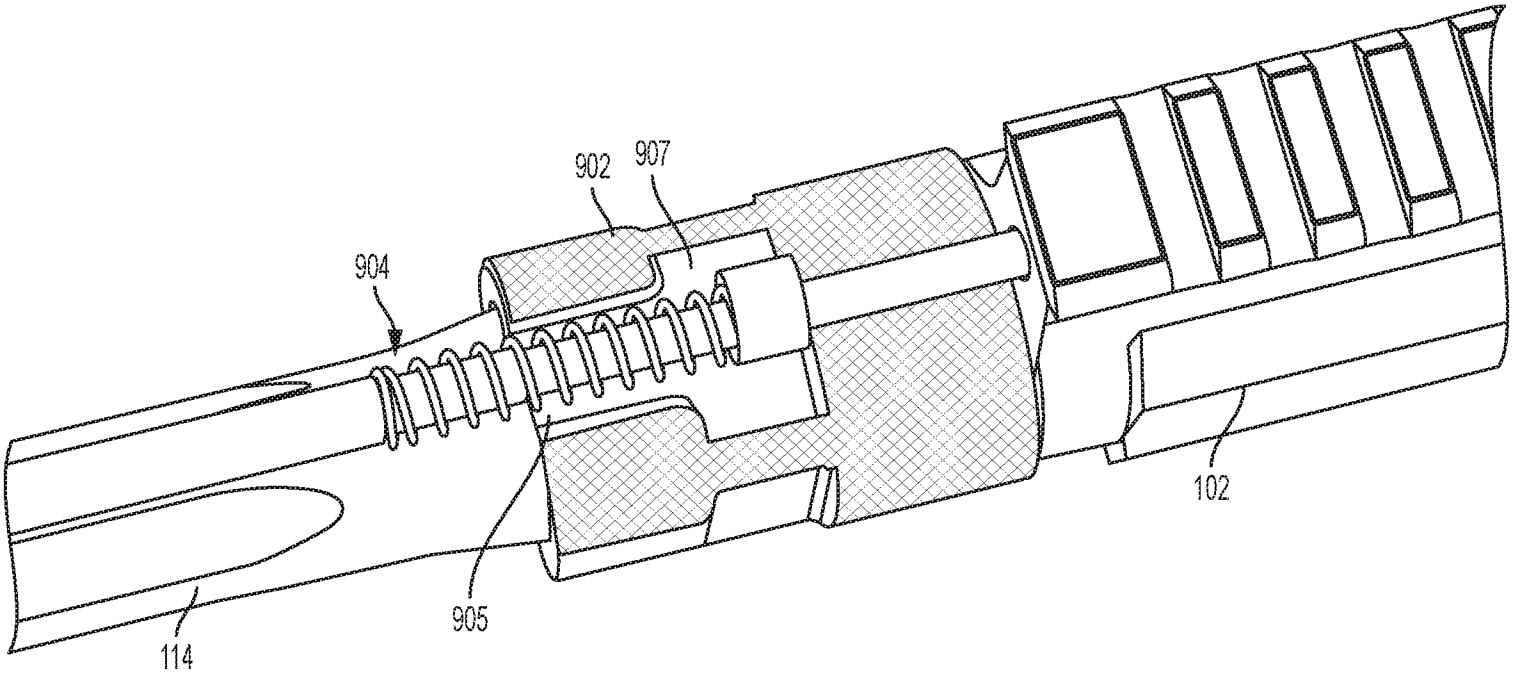
FIG. 11 illustrates a further view of a piston system barrel nut and related components mounted on a rifle in accordance with the embodiments described herein.

With reference to FIG. 9, another embodiment may include a piston system barrel nut 902 to accommodate rifles equipped with piston system components 904. For example, the piston system barrel nut 902 may include a channel 905 and gripping means 907 to accommodate a drive rod 906, drive rod spring 908, and drive rod bushing 910. With further reference to FIG. 10, the piston system barrel nut 902 may be affixed to the upper receiver 102 and carry the barrel 114. With still further reference to FIG. 11, a top view of the piston system barrel nut 902 illustrates that alignment of the barrel 114, piston system barrel nut 902, and upper receiver 102 may be achieved without completing the typical timing process. For example, alignment may be achieved as long as the piston system barrel nut 902 is affixed to the upper receiver such that the piston system components 904 lie within the channel 905 and the gripping means 907. As with other embodiments, the piston system barrel nut 902 may be affixed to the upper receiver 102 with a force ranging from about 35 to 85 foot/pounds of torque. The handguard 200 may then be secured to the barrel nut 902 with two or more sleeve mounting fasteners 604 in a similar manner as that described above with reference to the barrel nut 606. Timing the piston system barrel nut 902 and the use of shims or other material to facilitate the typical timing process to align the barrel 114, barrel nut 902, and handguard 200 is, thus, unnecessary.

The invention can provide various combinations of all of the features revealed and explained in conjunction with individual embodiments of the invention, and advantageous effects of these can therefore be realized simultaneously.

Further, the figures depict preferred embodiments of a rifle handguard system for purposes of illustration only. One skilled in the art will readily recognize from the discussion that alternative embodiments of the structures and methods illustrated herein may be employed without departing from the principles described herein.

Upon reading this disclosure, those of skill in the art will appreciate still additional alternative structural and functional designs for the systems and methods described herein through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the systems and methods disclosed herein without departing from the spirit and scope of the invention.

The invention claimed is:

1. A system comprising:

a barrel nut configured to fasten to an upper receiver of a rifle and further configured to carry a rifle barrel; and a single-piece rifle handguard having a muzzle end and a receiver end, the receiver end shaped to receive the barrel nut, the receiver end further including one or more sleeve mounting screw holes at the receiver end, the one or more sleeve mounting screw holes shaped to receive a threaded sleeve mounting fastener;

at least two sleeve chambers running along at least a portion of a longitudinal axis of an inner surface of the rifle handguard at the receiver end; and at least two sleeves each including one or more threaded sleeve mounting screw holes;

wherein a first sleeve of the at least two sleeves is contained within and supported by a first sleeve chamber of the at least two sleeve chambers, a second sleeve of the at least two sleeves is contained within a second sleeve chamber of the at least two sleeve chambers, and the one or more threaded sleeve mounting screw holes align with the one or more sleeve mounting screw holes to receive the threaded sleeve mounting fastener for affixing the rifle handguard to the barrel nut via friction between the inner surface of the rifle handguard and an outer surface of the barrel nut.

2. The system of claim 1, wherein the first sleeve chamber is positioned greater or less than 180° around the inner surface of the rifle handguard relative to positioning of the second sleeve chamber.

3. The system of claim 2, wherein each of the one or more threaded sleeve mounting fasteners is configured to abut the outer surface of the barrel nut.

4. The system of claim 3, wherein the at least two sleeve chambers are positioned around the inner surface of the rifle handguard such that tightening the one or more threaded sleeve mounting fasteners to abut the outer surface of the barrel nut forces a top portion of the outer surface of the barrel nut against an inner surface of a top portion of the rifle handguard.

5. The system of claim 4, wherein the outer surface of the barrel nut includes knurling.

6. The system of claim 5, wherein the at least two sleeves are made of a first material that is harder than a second material of the rifle handguard.

7. The system of claim 6, wherein the barrel nut includes gripping means to allow rotational force to be exerted against the barrel nut while carrying the rifle barrel to affix the barrel nut and rifle barrel to the upper receiver.

8. The system of claim 7, wherein gripping means includes a channel configured to accommodate piston system components along a top surface of the barrel nut.

9. The system of claim 1, wherein the rifle handguard includes an attachment rail running continuously along a top surface of both the rifle handguard and the upper receiver.

10. The system of claim 1, wherein the rifle handguard includes a plurality of cutouts.

11. A rifle handguard system comprising:

a barrel nut configured to fasten to an upper receiver of a rifle and further configured to carry a rifle barrel; and a single-piece rifle handguard having a muzzle end and a receiver end, the receiver end shaped to receive the barrel nut, the receiver end further including one or more sleeve mounting screw holes shaped to receive one or more threaded sleeve mounting fasteners corresponding to the one or more sleeve mounting screw holes, the rifle handguard including at least two sleeve chambers running along at least a portion of a longitudinal axis of an inner surface of the rifle handguard;

at least two sleeves including threaded holes for receiving the one or more threaded sleeve mounting fasteners;

wherein each of the at least two sleeves is contained within and supported by a sleeve chamber of the at least two sleeve chambers, and the threaded holes align with the one or more sleeve mounting screw holes to receive the one or more threaded sleeve mounting fasteners to exert a radial force against the barrel nut that also forces an outer surface of a top portion of the barrel nut against an inner surface of a top portion of the rifle handguard.

12. The rifle handguard system of claim 11, wherein the outer surface of the barrel nut includes knurling.

13. The rifle handguard system of claim 12, wherein the at least two sleeves are made of a first material that is harder than a second material of the rifle handguard.

14. The rifle handguard system of claim 13, wherein the barrel nut includes gripping means to allow rotational force to be exerted against the barrel nut while carrying the rifle barrel to affix the barrel nut and rifle barrel to the upper receiver.

15. The rifle handguard system of claim 14, wherein gripping means includes a channel configured to accommodate piston system components along a top surface of the barrel nut.

16. The rifle handguard system of claim 11, wherein the rifle handguard includes an attachment rail running continuously along a top surface of both the rifle handguard and the upper receiver.

17. The rifle handguard system of claim 11, wherein the rifle handguard includes a plurality of cutouts.

* * * * *